US005307389A

United States Patent [19]

Meneely et al.

[11] Patent Number: 5,307,389

[45] Date of Patent: Apr. 26, 1994

[54] SYSTEM FOR REMOVING LIQUID WASTE FROM A TANK

[75] Inventors: Timothy K. Meneely, Penn Hills; Catherine A. Sherbine, N. Versailles Township, Allegheny County, both of Pa.

[73] Assignee: Westinghouse Electric Corp., Pittsburgh, Pa.

[21] Appl. No.: 54,507

[22] Filed: Apr. 27, 1993

[51] Int. Cl.[5] ..... G21F 9/22

[52] U.S. Cl. ..... 376/272; 252/633; 250/506.1; 220/4.12; 976/DIG. 388

[58] Field of Search ..... 376/272; 252/633, 631; 250/506.1; 210/207, 800; 220/565, 4.12; 976/DIG. 388, DIG. 387, DIG. 379

[56] References Cited

U.S. PATENT DOCUMENTS

| | | | |
|---|---|---|---|
| 1,773,930 | 8/1930 | Anthon | 220/565 |
| 2,256,673 | 9/1941 | Hansen | 220/565 |
| 3,024,942 | 3/1962 | Schmitz | 220/4.12 |
| 3,684,092 | 8/1972 | Busse et al. | 210/800 |
| 4,638,920 | 1/1987 | Goodhues | 220/565 |
| 4,844,276 | 7/1989 | Kunze | 976/DIG. 388 |
| 4,948,519 | 8/1990 | Zeh | 210/4.12 |
| 5,002,195 | 3/1991 | Lasson | 220/4.12 |
| 5,197,627 | 3/1993 | Disabato et al. | 220/4.12 |

*Primary Examiner*—Daniel D. Wasil

*Attorney, Agent, or Firm*—Peyton C. Watkins

[57] ABSTRACT

A tank especially suited for nuclear applications is disclosed. The tank comprises a tank shell for protectively surrounding the liquid contained therein; an inlet positioned on the tank for passing a liquid into the tank; a sump positioned in an interior portion of the tank for forming a reservoir of the liquid; a sloped incline for resting the tank thereon and for creating a natural flow of the liquid toward the sump; a pump disposed adjacent the tank for pumping the liquid; and a pipe attached to the pump and extending into the sump for passing the liquid therethrough. The pump pumps the liquid in the sump through the pipe and into the pump for discharging the liquid out of the tank.

5 Claims, 2 Drawing Sheets

SYSTEM FOR REMOVING LIQUID WASTE FROM A TANK

The United States Government has rights in the invention pursuant to an Agreement between the United States Department of Energy and Westinghouse Electric Corporation under contract No. DE-AC03-90SF18495.

BACKGROUND OF THE INVENTION

1. Field of the Invention

The present invention relates generally to a nuclear liquid waste tank and, more particularly, to a system for removing liquid waste from such a waste tank.

2. Description of the Prior Art

A typical nuclear power facility includes a nuclear reactor wherein a controlled nuclear reaction, which generates heat, is occurring. Typically, borated water is contained in the reactor for controlling the nuclear reaction process and for passing the heat away from the reactor. A primary loop communicating with the reactor functions to pass the borated water (i.e., the heat) away from the reactor and to transfer the heat to a secondary loop. The secondary loop is isolated from the primary loop and generates steam from the heat passed from the primary loop. The steam of the secondary loop is used to produce electricity as is well known in the art. The primary loop then returns the borated water back into the reactor where the above described process is repeated.

It may become necessary during normal operation, maintenance purposes, or the like to withdraw or insert borated water into the primary loop. In this regard, two pipes are attached to the primary loop; one for adding additional borated water and the other for withdrawing borated water. The withdrawn borated water (i.e., liquid waste) is passed to a series of waste tanks where the borated water is processed in each tank before being released to the environment.

These liquids which are exposed to radiation (i.e, the liquid waste) must be properly treated before being introduced to the environment. A portion of this treatment typically occurs in cylindrical waste tanks.

The waste tanks each have a cylindrical shaped housing enclosed on both its ends by circular shaped ends. Each tank is laid over on its side, and an outlet is attached to the lower portion of one end for selectively releasing the liquid waste inside. A pump is attached atop the housing, and a pipe extends between the pump and the outlet. The pump functions to suction the liquid waste out of the tanks. The liquid waste, after being properly mixed, sampled, and treated within the tank, may either be released for further processing if it is not the final tank in the series or released to the environment if it is the final tank in the series.

Although the present system for withdrawing the liquid waste from the tanks is satisfactory, it is not without drawbacks. Dust and the like may settle in the tank interior adjacent to the outlet and, therefore, clog the outlet which prevents drainage. Further, incomplete drainage may occur because the outlet, although near the end lower portion, will not completely drain the liquid waste below the outlet. Still further, mixing the contents of the tank and cleaning the tank requires additional devices which are not part of the tank.

Consequently, a need exists for improvements in the construction of nuclear tanks containing liquid waste to facilitate drainage.

SUMMARY OF THE INVENTION

The present invention provides an improvement designed to satisfy the aforementioned needs. Particularly, the present invention is directed to a cylindrical tank for nuclear applications having an interior portion for containing a liquid; the tank comprising a tank shell for protectively surrounding the liquid contained therein; an inlet positioned on the tank for passing the liquid into the tank; a sump positioned in the interior portion of the tank for forming a reservoir of the liquid; a sloped incline for resting the tank thereon and for creating a natural flow of the liquid toward the sump; a pump disposed adjacent the tank for pumping the liquid; and a pipe attached to the pump and extending into the sump for passing the liquid waste therethrough. With this arrangement, the pump pumps the liquid waste in the sump through the pipe and into the pump for discharging the liquid out of the tank.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
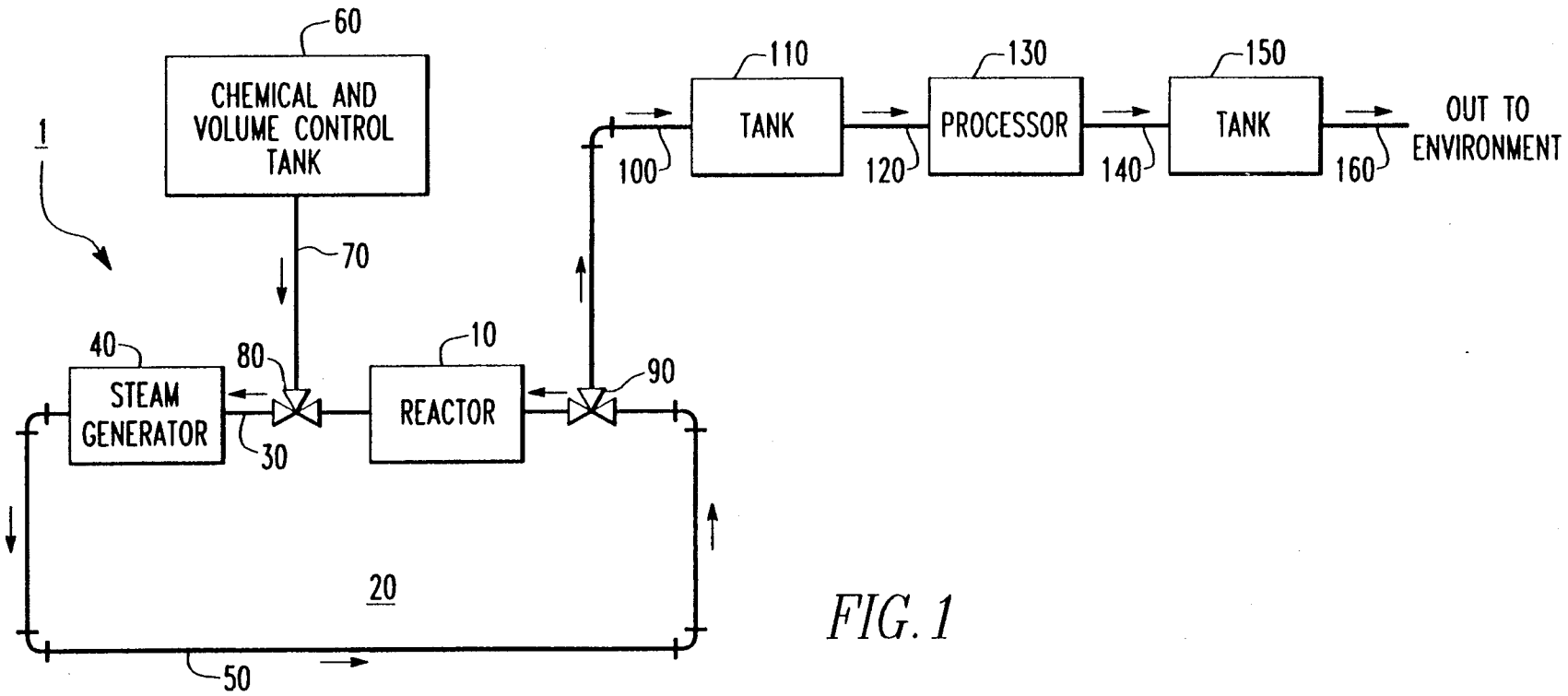
FIG. 1 is a schematic diagram of a portion of a nuclear power plant including a liquid waste system.

In the following description, like reference characters designate like or corresponding parts throughout several views of the drawings. Also in the following description, it is to be understood that such terms as "forward", "rearward", "left", "right", "upwardly", "downwardly", and the like are words of convenience and are not to be construed as limiting terms.

Referring now to the drawings wherein like reference numerals refer to like elements, FIG. 1 depicts a portion of a nuclear plant facility, such as a pressurized water nuclear reactor 1 containing a reactor, generally referred to as 10, for generating heat by nuclear reactions. Typically, a primary coolant such as borated water (not shown) inside the reactor 10 functions to control the nuclear reaction process and to convey the generated heat away from the reactor 10. The primary coolant, which may become radioactive, in reactor 10 flows through a portion of a closed loop, generally referred to as a primary loop 20. Referring to such primary loop 20, the primary coolant flows out of reactor 10 through pipe 30 to a steam generator 40 wherein the primary coolant, heated by the reactor 10, transfers its heat to a water-filled secondary system (not shown). Steam is created in the steam generator 40 from water in the secondary system and is conveyed to a turbine-generator set (not shown) for producing electrical power, as is well known in the art. In the primary loop 20, the primary coolant exits the steam generator 40 via a pipe 50 and returns to the reactor 10 to repeat the above described process.

Due to operating conditions or for maintenance purposes, at least a portion of the primary coolant in the primary loop may have to be withdrawn or additional coolant inserted into the primary loop. In this regard, a chemical and volume control tank 60 stores additional coolant and, when necessary, passes this coolant to the primary loop 20 via a pipe 70. A valve 80 is positioned on the pipe 70 and is opened to allow the coolant to pass into the primary loop 20 or closed to prevent the coolant from flowing into the primary loop 20. When it is required to withdraw coolant, a valve 90 is opened, and the primary coolant flows out of the pipe 50, through the valve 90, and into a pipe 100. The coolant then flows into a borated waste holdup tank 110 where the coolant is treated by a chemical process itself well known in the art. The treated water flows, via a pipe 120, out of the borated waste holdup tank 110 into a processor 130, such as an ion exchanger/filter arrangement also well known in the art, for additional treatment. The water flows out of the processor 130, via a pipe 140, and into a waste monitor tank 150. The contents of the waste monitor tank 150 are mixed and sampled by methods well known in the art, and, if found to be acceptable, are discharged into a discharge canal (not shown) or the like via a pipe 160 for disposal. If the sample is unacceptable, further chemical treatment occurs in the tank 150 before it is discharged.

Figure 2:
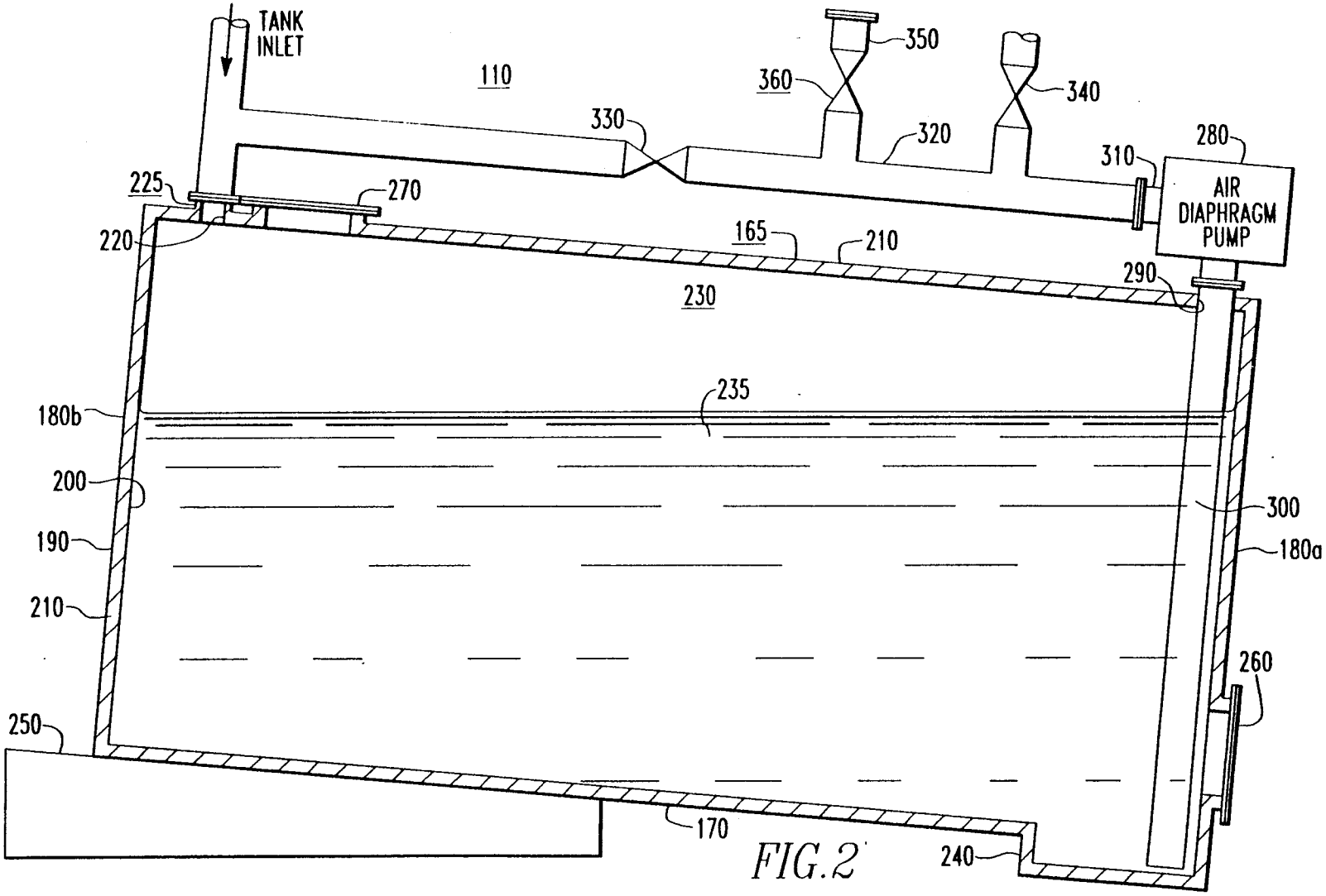
FIG. 2 is a side elevational view of a tank of the present invention for containing the liquid waste.

Now referring to FIG. 2, there is illustrated a tank representative of either the borated waste holdup tank 110 or the waste monitor tank 150. For discussion purposes, the tank illustrated in FIG. 2 will be referred to as the tank 110. The tank 110 which is the subject of the present invention includes tank shell 165 having a cylindrical side wall 170 enclosed on both its ends by a circular end 180*a* and 180*b*. The side wall 170 and the ends 180*a* and 180*b* are integral with each other. Both the side wall 170 and the ends 180*a* and 180*b* have an outside surface 190 and an inside surface 200 defining a wall 210 of desired thickness therebetween. A first bore 220 extends through the wall 210 of the side wall 170 for allowing liquid waste 235 to enter the tank 110. An inlet flange 225 is disposed about the bore 220 to allow a pipe or the like to be connected to the tank 110. The tank 110 has an interior 230 where the liquid waste 235 may be stored. A recessed portion, generally referred to as a sump 240, is positioned in the interior 230 of the tank 110 adjacent the end 180*a* and forms part of the side wall 170. The sump 240 creates a reservoir of liquid waste 235 for holding the liquid waste 235 before it leaves the tank 110.

The tank 110 is positioned so that the tank side wall 170 rests on a sloped incline 250 which creates a natural flow of the liquid waste 235 in the tank interior 230 towards the sump 240. The incline 250 may be formed from pallets or the like. A first manway 260 is located on one end 180*a* of the tank allowing access into the tank interior 230. The manway 260 may be bolted or secured by other suitable means to the end 180*a*. A second manway 270 is located on the side wall 170 and allows inspection equipment to be inserted into the tank interior 230. The second manway 270 is also secured to the side wall 170.

A self priming pump, such as an air diaphragm pump 280, is positioned atop the tank outer surface 190 for pumping the liquid waste 235 therefrom. The pump 280 may be a Sandpiper Model EB3-A manufactured by Warren-Rupp Incorporated in Mansfield, Ohio. The pump 280 communicates with a second bore 290 positioned beneath the pump 280 and extending through the wall 210 of the side wall 170. The bore 290 also communicates with a pipe 300 positioned within the interior 230 of the tank 110. The pipe 300 extends between the sump 240 and the pump 280. The pump 280, when operational, draws the liquid waste 235 out of the sump 240 and through the pump 280. A pump outlet 310 is positioned on the pump 280 wherein a pipe 320 is attached thereto. The pipe 320 extends along the longitudinal length of the tank 110 and attaches to the first bore 20. The pipe 320 allows the liquid waste 235 to re-enter the tank 110, if necessary, for mixing and the like. A valve 330 is positioned on the pipe 320 to prevent (i.e., valve in closed position) or allow (i.e., valve in open position) the liquid waste 235 to re-enter the tank 110. A discharge valve 340 is disposed on the pipe 320 for allowing the liquid waste 235 to exit the tank 110 and flow to the processor 130 (see FIG. 1). A lance connection 350 is also attached to the pipe 320 for attaching a hose (not shown) or the like. The hose may then be inserted into the second manway 270 for manually re-circulating the waste water 235. A valve 360 is attached to the lance connection for allowing a passageway to the lance connection 350.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

What is claimed is:

1. A cylindrical tank assembly for nuclear waste applications having an interior portion for containing a liquid, the tank assembly comprising:

a) a tank shell for protectively surrounding the liquid contained therein;

b) an inlet positioned on the tank for passing the liquid into the tank;

c) a sump positioned in the interior portion of the tank for forming a reservoir of the liquid;

d) a sloped incline for resting the tank thereon and for creating a natural flow of the liquid toward said sump;

e) a pump cooperating with the tank for pumping the liquid;

f) a pipe attached to said pump and extending into said sump for passing the liquid therethrough; wherein said pump pumps the liquid in said sump through said pipe and into said pump for discharging the liquid out of the tank; and g) a recirculation pipe attached to both said pump and said inlet for recirculating the liquid waste therethrough and including a valve for controlling the flow of the liquid waste therethrough.

2. The apparatus as in claim 1 further comprising a discharging means attached to said recirculation pipe for discharging the liquid from said pump.

3. The apparatus as in claim 2 further comprising a connection means attached to said recirculation pipe for allowing the liquid to be passed into the tank for maintenance purposes.

4. The apparatus as in claim 3 further comprising a first manway positioned atop the exterior portion of the tank allowing access into the tank.

5. The apparatus as in claim 4 further comprising a second manway disposed on a side of the tank for allowing passageway into the tank.

* * * * *